US007534160B2

(12) United States Patent
Cooper et al.

(10) Patent No.: US 7,534,160 B2
(45) Date of Patent: May 19, 2009

(54) PRECISION MACHINE TOOL

(76) Inventors: Alex Cooper, 30-96 Brighton 6 #D3, Brooklyn, NY (US) 11235; Yevgeny Bederak, 47 Tougview Dr., Long Meadow, MA (US) 01106; Alexander Bederak, 47 Tougview Dr., Long Meadow, MA (US) 01106

( * ) Notice: Subject to any disclaimer, the term of this patent is extended or adjusted under 35 U.S.C. 154(b) by 0 days.

(21) Appl. No.: 11/332,762

(22) Filed: Jan. 17, 2006

(65) Prior Publication Data

US 2007/0167111 A1 Jul. 19, 2007

(51) Int. Cl.
*B24B 49/00* (2006.01)
*B24B 41/06* (2006.01)

(52) U.S. Cl. ..... 451/5; 451/411; 451/412; 451/414; 108/6; 108/37; 384/445; 384/490; 384/549; 384/558

(58) Field of Classification Search ..... 451/5, 451/411, 412, 414; 108/6, 37; 384/445, 384/490, 549, 558
See application file for complete search history.

(56) References Cited

U.S. PATENT DOCUMENTS 1,967,168 A * 7/1934 Zuber ..... 72/229
3,276,607 A * 10/1966 Thomas et al. ..... 414/16
3,790,003 A * 2/1974 Tausheck ..... 414/494

* cited by examiner

*Primary Examiner*—Lee D. Wilson
*Assistant Examiner*—Shantese McDonald
(74) *Attorney, Agent, or Firm*—I. Zborovsky

(57) ABSTRACT

A precision machine tool, comprising a table which is suspended so that it is substantially a swivelable table; a driving element for driving a tood during machining of a part; and a device for orienting said table, said orienting device including at least three orienting elements, each including a plurality of rolling bodies which are brought successively into a contact with a surface of said table on which work pieces to be machined are located.

6 Claims, 3 Drawing Sheets

PRECISION MACHINE TOOL

BACKGROUND OF THE INVENTION

The present invention relates to precision machine tools for machining flat parts of different materials.

More particularly, it relates to precision grinding of parts composed of glass, ceramic, semi-conductors and other materials.

Machine tools of the above-mentioned general type are known in the art. Such machine tools is disclosed for example in Soviet inventor's Certificates Nos. 390,924 and 622,650. They are used for grinding flat parts and include a rotary table with a changeable flat plate for attaching parts to be machined on its base surface, and a rotatable abrasive tool. The machine tools disclosed in these references have an orientation mechanism which is in contact with the base surface of the pivotal flat area of the changeable flat plate. The orientation mechanism includes two rings with bearing balls located between them. One ring is non-rotatable, while the other ring rotates in contact with the pivotal area of the flat blade. The above-mentioned machine tools have certain disadvantages. The device is limited to the sizes of the rings and do not allow building of orientation mechanisms of greater dimensions with flatness on the rings about 1 micron or less, since greater diameters require greater flatness tolerances of the parts to be machined. It is advisable to improve the machines tools of this general type.

SUMMARY OF THE INVENTION

Accordingly, it is an object of the present invention to provide a precision machine tool which is a further improvement of the existing precision machine tools of this type.

In keeping with these objects and with others which will become apparent hereinafter, one feature of the present invention resides, briefly stated, in a precision machine tool which has a spindle for driving a tool; a table for placing a work piece; and an orientation mechanism including at least three orientation elements, each of the orientation elements being formed by a plurality of rolling bodies which are capable of continuously rolling on a surface of the table during operation of the machine tool.

When the precision machine tool is designed in accordance with the present invention, it eliminates the disadvantages of the prior art.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
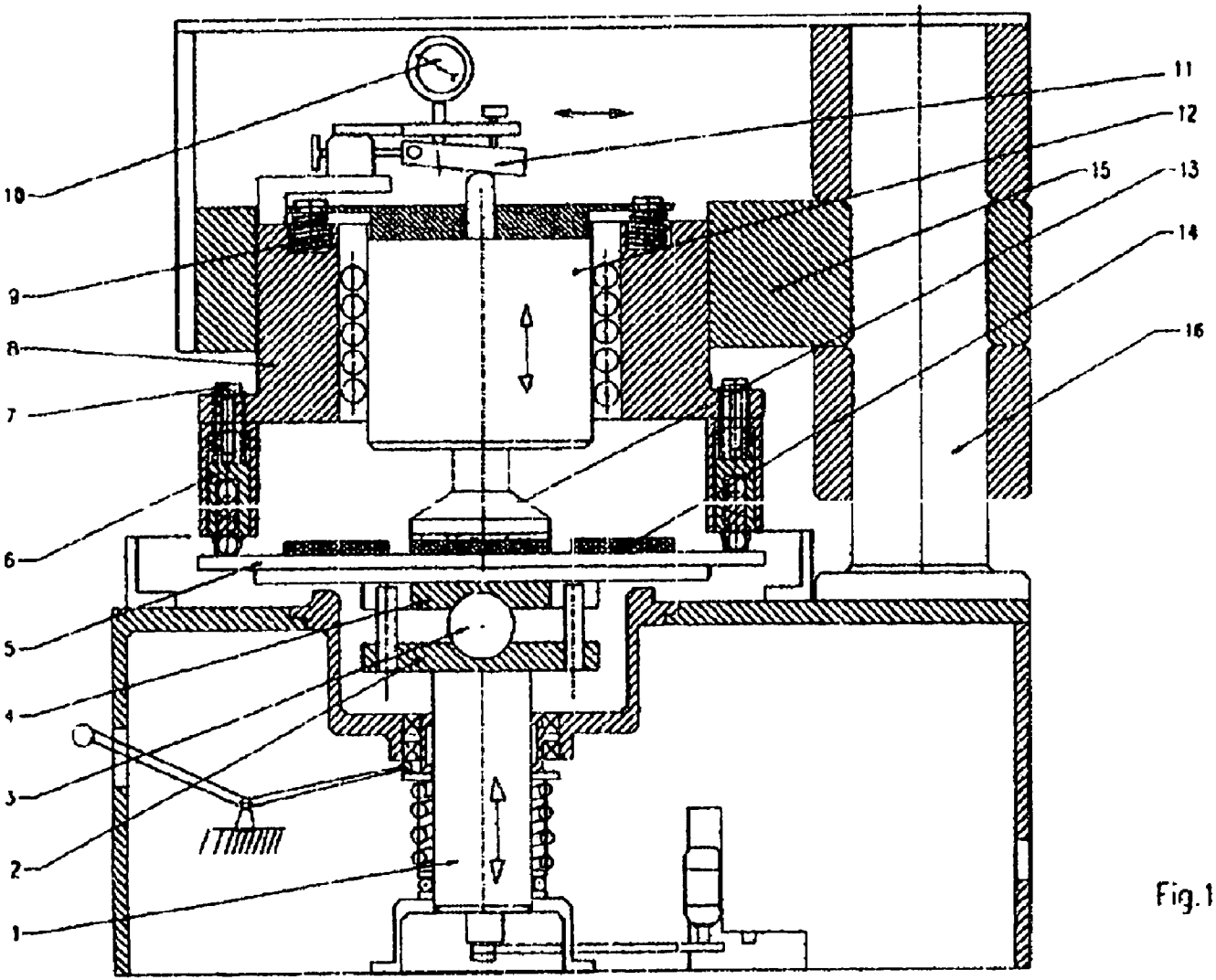
FIG. 1 is a view schematically showing a precision machine tool in accordance with the present invention.

A precision machine tool in accordance with the present invention has a lower spindle which is identified as reference numeral 1 and supporting lower plate 2 which, through a ball 3 supports an upper plate 4 of a swivelable table 5 having an upper surface for supporting work pieces.

At least three orientation elements 6 are provided around an axis of the table and attached by bolts 7 to a holder 8. Springs 9 urge an upper spindle 10 to a wedge 11. A motor 12 moves the wedge 11 and thereby the spindle 12 which carries a tool 13 formed as a grinding tool, a polishing tool, etc. Work pieces 14 are supported on an upper surface of the table. The holder 8 is arranged in the guide 15 which in turn is supported on a column 16.

Figure 6:
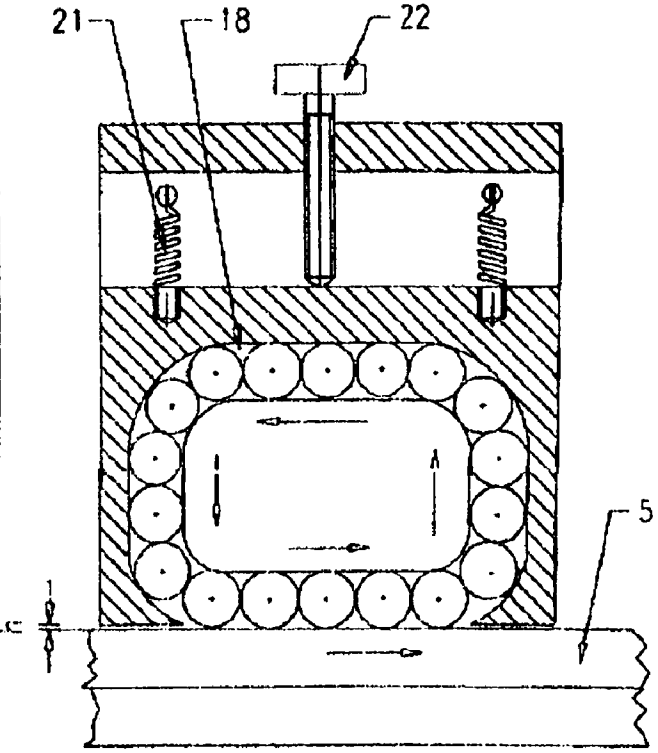
FIG. 6 is a view showing a transverse cross section of the orientation element.
Figure 5:
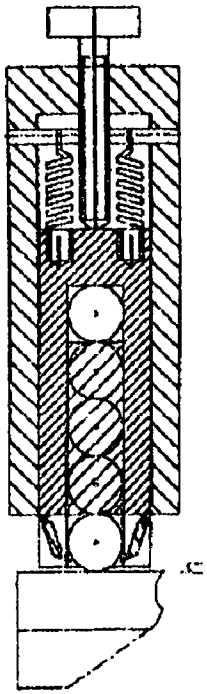
FIGS. 2, 3, 4, and 5 are views showing a cross section of an orientation element in different phases.
Figure 4:
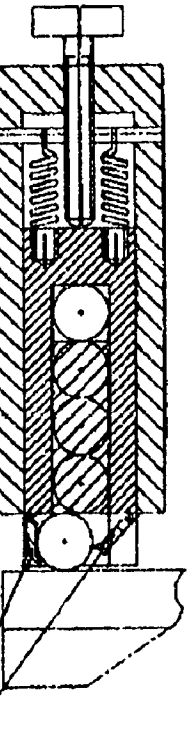
Figure 3:
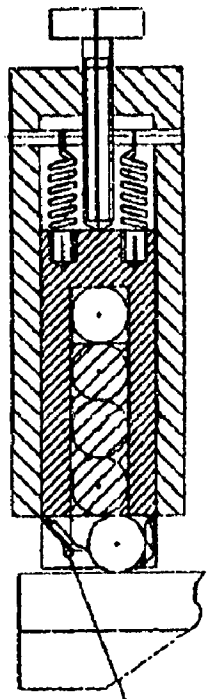
Figure 2:
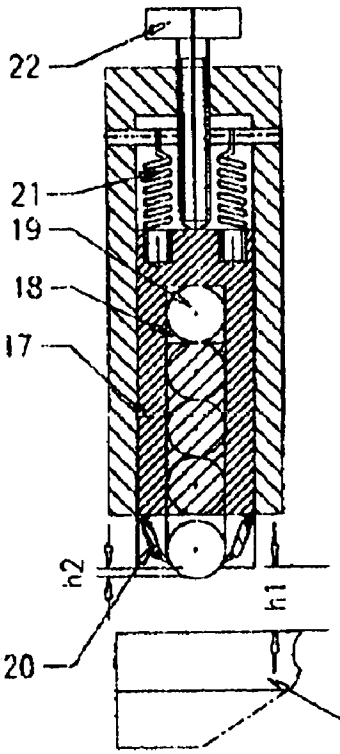
Figure 7:
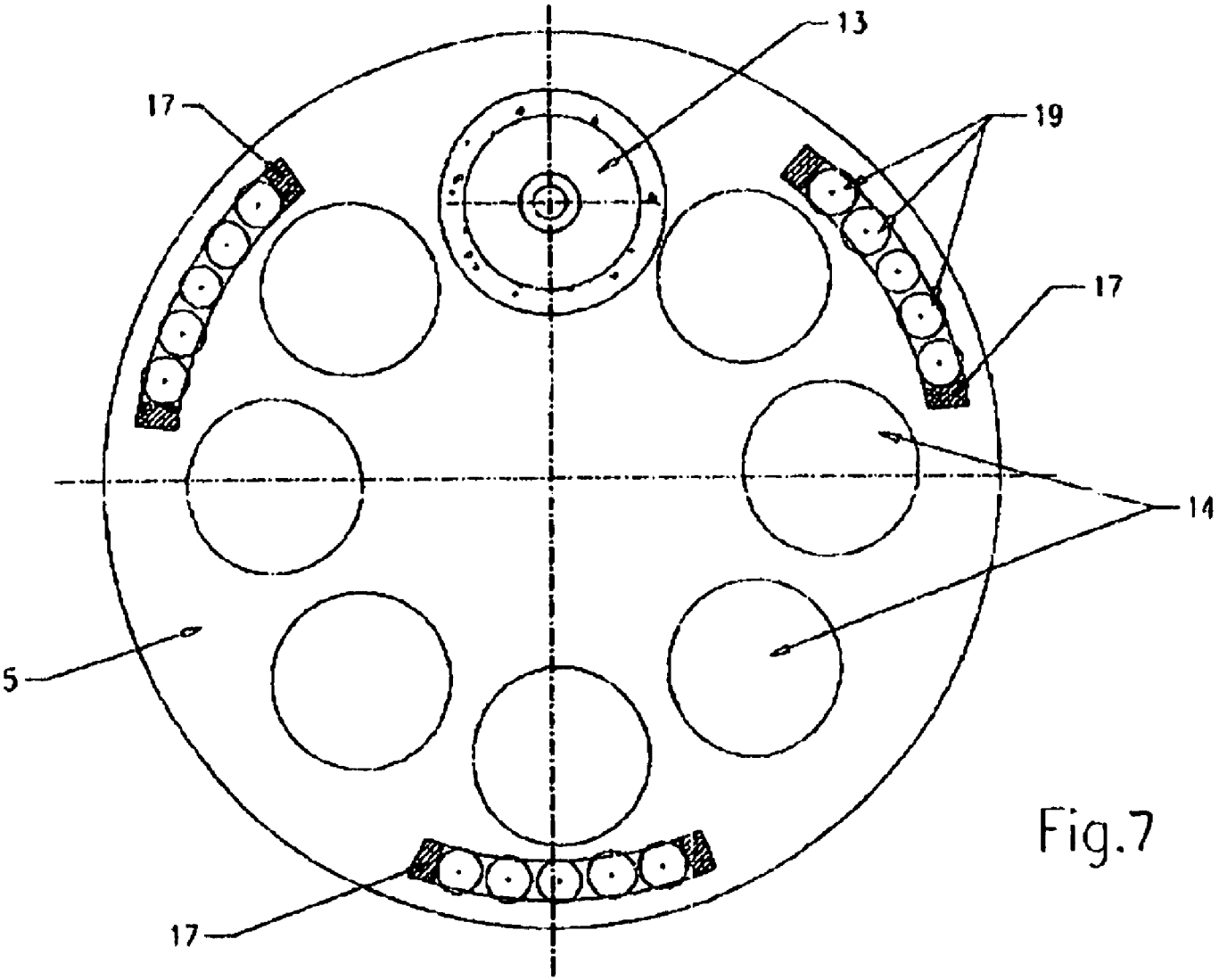
FIG. 7 is a plan view of the swivelable table.

The orientation elements 6 are shown in FIGS. 2-6. Each orientation element includes a body 17 with a guide 18 provided in it, and a plurality of rolling elements which can be formed as balls 19. During the operations, the balls 19 can roll in the guide 17 shown in FIG. 6, which is a formed as a substantially rectangular guide with rounded edges. Thus, the friction between the rolling bodies (balls) and the upper surface of the table is significantly reduced and subsequent balls are brought in contact with the upper surface of the table. Also, the positions of the balls in contact with the upper surface of the table change during the operation as shown in FIGS. 2-5.

Reference numeral 20 identifies yieldable holders which hold the ball in a lateral direction and allow its lateral displacement within a limited range. They also hold the balls in the guide before the orientation elements are placed on the table. Reference numeral 21 identifies springs and bolts 22 allows adjustment of the position of the balls in all orienting elements relative to one another.

Since the orientation elements include the above-mentioned plurality of rolling bodies, the orientation is performed in a reliable manner, there is no limitation as to the size and accuracy of the orientation elements, and the accuracy of orientation of the table is substantially increased.

It will be understood that each of the constructions described above, or two or more together, may also find a useful application in other types of constructions differing from the types described above.

While the invention has been illustrated and described as embodied in a precision machine tool, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claims as new and desired to be protected by Letters Patent is set forth in the appended claims.

The invention claimed is:

1. A precision machine tool, comprising a table which is suspended so that it is substantially a swivelable table; a driving element for driving a tool during machining of a part; and means for orienting said table, said orienting means including at least three orienting elements located around an axis of said table, each including a plurality of rolling bodies which are brought successively into a contact with a surface of said table on which work pieces to be machined are located.

2. A precision machine tool as defined in claim 1, wherein said rolling bodies are formed as balls.

3. A precision machine tool as defined in claim 1, wherein each of said orienting elements includes a body with a guide in which said rolling bodies are located.

4. A precision machine tool as defined in claim 3, wherein said guide is formed as a continuous guide.

5. A precision machine tool as defined claim 4, wherein said continuous guide has a substantially rectangular shape with rounded corners.

6. A precision machine tool as defined in claim 4; further comprising flexible side elements which allow a limited lateral displacement of said rolling elements.

* * * * *